US008201700B2

(12) United States Patent
Shibata et al.

(10) Patent No.: US 8,201,700 B2
(45) Date of Patent: Jun. 19, 2012

(54) CONTAINER FOR INSPECTION

(75) Inventors: Tomoyuki Shibata, Yokohama (JP); Manabu Hosokawa, Yokohama (JP); Hiroaki Hayashi, Yokohama (JP); Natsuki Masuya, Yokohama (JP); Yoshiaki Seto, Otawara (JP); Shingo Saito, Tokyo (JP); Hidetoshi Kanda, Otawara (JP)

(73) Assignees: Toyo Seikan Kaisha, Ltd., Tokyo (JP); Eiken Kagaku Kabushiki Kaisha, Tokyo (JP)

( * ) Notice: Subject to any disclaimer, the term of this patent is extended or adjusted under 35 U.S.C. 154(b) by 373 days.

(21) Appl. No.: 12/448,850

(22) PCT Filed: Jan. 18, 2008

(86) PCT No.: PCT/JP2008/050563

§ 371 (c)(1),
(2), (4) Date: Aug. 18, 2009

(87) PCT Pub. No.: WO2008/090806

PCT Pub. Date: Jul. 31, 2008

(65) Prior Publication Data

US 2010/0044337 A1 Feb. 25, 2010

(30) Foreign Application Priority Data

Jan. 25, 2007 (JP) ..... 2007-014853

(51) Int. Cl.

| | |
|---|---|
| ***B65D 51/20*** | (2006.01) |
| ***B65D 51/18*** | (2006.01) |
| ***B65D 39/00*** | (2006.01) |
| ***B65D 41/00*** | (2006.01) |
| ***B65D 41/04*** | (2006.01) |
| ***B65D 41/34*** | (2006.01) |

(52) U.S. Cl. ..... 215/253; 215/227; 215/257; 215/295; 215/329; 215/331; 215/335; 220/255.1; 220/258.1; 220/258.4

(58) Field of Classification Search ..... 215/227, 215/253, 257, 295, 329, 331, 335; 220/225.1, 220/258.1, 258.4
See application file for complete search history.

(56) References Cited

U.S. PATENT DOCUMENTS 4,722,449 A 2/1988 Dubach
(Continued)

FOREIGN PATENT DOCUMENTS

JP 2001-171716 6/2001
(Continued)

OTHER PUBLICATIONS

"Principle of Lamp (Loop-Mediated Isothermal Amplification) Method—simplifying and prompt amplifying method of gene "; Hiroshi Ushikubo; Gene Examination Team / Marketing Management Department / Eiken Chemical Co., Ltd.; Virus vol. 54, No. 1, pp. 107-112, 2004.

*Primary Examiner* — Anthony Stashick
*Assistant Examiner* — Madison L Wright
(74) *Attorney, Agent, or Firm* — Manabu Kanesaka

(57) ABSTRACT

Provided is a container 1 for inspection which stores and pours out contents therein, and the container is provided with a container main body 2 having a mouth portion 22 formed thereon, a cover portion 3 attached to the mouth portion 22 to seal the container main body 2, and an opening cap 4 attached to the cover portion 3. The cover portion 3 has a closing wall 34 for closing the mouth portion 22, and the opening cap 4 is provided with an pouring outlet 421, and a cutting portion 431 for cutting the closing wall 34. When the opening cap 4 is attached to the cover portion 3, the cutting section 431 cuts the closing wall 34 to enable pouring out the contents.
Thus, in the provided container 1 for inspection, sealing properties of the container main body 2 are ensured by the cover portion 3, and the closing wall 34 of the cover portion 3 is cut by the opening cap 4 attached to the cover portion 3 without removing the cover portion 3, whereby the contents can be poured out.

12 Claims, 8 Drawing Sheets

U.S. PATENT DOCUMENTS

| | | | | |
|---|---|---|---|---|
| 5,186,344 | A * | 2/1993 | Cook | 215/330 |
| 6,116,445 | A | 9/2000 | Ikemori et al. | |
| 6,477,743 | B1 * | 11/2002 | Gross et al. | 222/525 |
| 2005/0016875 | A1 * | 1/2005 | Rodriguez | 206/219 |
| 2008/0142471 | A1 * | 6/2008 | Yorita | 215/228 |

FOREIGN PATENT DOCUMENTS

| | | |
|---|---|---|
| JP | 2001-240106 | 9/2001 |
| JP | WO 2006/132041 | 12/2006 |
| WO | WO 2006/046721 | 5/2006 |

* cited by examiner

CONTAINER FOR INSPECTION

TECHNICAL FIELD

The present invention relates to a container which can open a sealed container without removing a cover or a cap therefrom to pour out a suitable amount of contents therein. More particularly, it relates to the improvement of a container for inspection for use in the inspection and diagnosis of an analyte in the field of medical treatment or medical drug.

BACKGROUND ART

For genetic tests in the field of medical treatment or medical drug, there are known some techniques for inspecting each analyte which is sampled from a human organism to detect presence/absence of pathogenic bacteria.

In these techniques, much attention is paid to a gene amplifying method called a LAMP method which comprises mixing genetic DNAs of extracted pathogenic bacteria with a predetermined reagent, and then incubating the mixture at a predetermined temperature to amplify the target genetic DNA, thereby facilitating an inspection (VIRUS, Vol. 54, No. 1, pp. 107-112, 2004). This technique can shorten an inspection time as compared with conventional gene inspections and obtain an extremely great deal of the amplified product, whereby the presence/absence of the target gene can visually be judged to simplify the inspection.

DISCLOSURE OF THE INVENTION

Problems to be Solved the Invention

However, in a case where a gene is amplified by such a technique, particularly in a case where a gene which is to be amplified is that of pathogenic bacteria such as tubercle bacillus liable to cause aerial infection, the following problems are present.

For example, in steps of mixing an analyte containing the tubercle bacillus with a predetermined reagent in a container having an opened mouth portion and thermally treating the mixture at a predetermined temperature to extract a target gene, the container might be fallen by mistake to spill contents therein, or the tubercle bacillus might fly into the air through the opened mouth portion of the container. In such a case, an inspector is exposed to the danger of infection with the tubercle bacillus, and hence the security of the inspector is not assured.

Furthermore, in order to avoid such a danger, there is a case where the thermal treatment is carried out while the container is sealed with a cover.

Even such a case, however, the cover has to be removed therefrom to pour out the extracted target gene, and a nozzle cap or the like for dropping a suitable amount of the gene has to be attached again to pour out the target gene. In consequence, occasion for contact between the inspector and the bacteria increases, which means that the danger increases. In addition, complicate steps such as attachment and detachment of parts are inconveniently required.

In order to solve such a complication of the attachment and detachment, for example, it is contrived that a cover is further attached onto the above-mentioned-nozzle cap.

In this case, however, both of sealing properties between the container and the nozzle cap as well as sealing properties between the nozzle cap and the cover have to be secure, and as the number of parts to be used increases, the danger of leakage and the like increases, which requires much attention.

As described above, the safety of the inspector is a problem which is to be secured even in a case other than a gene amplifying technique by a LAMP method. Furthermore, it is an important problem that the safety of the inspector is secured even in usual inspections other than a gene inspection, and complicate steps such as attachment and detachment of the cover and the cap in an inspection process are eliminated to establish both of the sealing properties of the container for inspection and the easiness of the extraction.

The present invention has been developed in view of the above situations, and an object of the present invention is to provide a container for inspection which can secure the sealing properties of the container containing contents by a cover portion and enables pouring out the contents without removing the cover portion.

Means for Solving the Problems

A container for inspection according to the present invention which solves the above problems is a container for inspection which stores and pours out contents therein, and the container includes a container main body having a mouth portion formed thereon, a cover portion attached to the mouth portion to seal the container main body, and an opening cap attached to the cover portion, wherein the cover portion has a closing wall for closing the mouth portion, the opening cap is provided with a pouring outlet and a cutting portion for cutting the closing wall, and when the opening cap is attached to the cover portion, the cutting portion cuts the closing wall to enable pouring out the contents.

According to the container for inspection of the present invention having such a constitution, the container main body containing the contents can be brought into a sealing state by the cover portion.

In consequence, the fly of pathogenic bacteria during the inspection and the like can be avoided, and the safety of an inspector can be secured.

Furthermore, when the opening cap is attached to the cover portion, the cutting portion formed in the opening cap cuts the closing wall of the cover portion, whereby the contents stored in the container main body can be poured out through the pouring outlet without removing the cover portion.

In consequence, it is possible to pour out the contents without removing the cover portion, whereby the safety of the inspector is secured and the complication of attachment and detachment of the opening cap can be eliminated, which improves an inspection efficiency and makes the inspection speedy to shorten a waiting time of a patient.

In addition, after the cut of the closing wall, the diffusion of the contents is minimized by the opening cap, whereby the safety of the inspector is secured and a necessary amount of the contents can be poured out.

Furthermore, the container for inspection of the present invention can be constituted so that the cutting portion pushes and cuts the closing wall.

According to such a constitution, for example, in a case of knock attachment by fitting the cover portion into the opening cap, the cutting portion can push and cut the closing wall simultaneously with the knock attachment, whereby the closing wall can be cut instantaneously, and the efficiency of the inspection can be improved.

Furthermore, the container for inspection according to the present invention can be constituted so that the cutting portion is revolved while contacting the closing wall, to cut the closing wall.

According to such a constitution, the closing wall can be gradually cut, so that it can be avoided that the contents are abruptly splashed by a difference between pressures inside and outside the container, whereby the safety of the inspector is secured.

Moreover, the cutting by the revolution enables securing a tubular pouring passage to surely pour out the contents.

Furthermore, the container for inspection according to the present invention may have a constitution that the opening cap is attached to the cover portion by screwing, and when the opening cap is screwed, the cutting portion cuts the closing wall.

According to such a constitution, the pushing pressure by the screwing of the opening cap and the revolution can give a cutting force to the closing wall, and hence the closing wall can be cut by the constant cutting force. In consequence, the stable cutting can be realized, and hence the security of the inspector and the sure pouring passage can be assured.

Furthermore, the container for inspection according to the present invention may have constitution that the cutting portion has control means for controlling the revolution range of the cutting portion to less than 360° after the cutting portion has begun to cut the closing wall, and the control means prevents a part of the closing wall to be cut, whereby the fall of the closing wall is avoided.

According to such a constitution having the control means, for example, in a case where the closing wall is cut by the screwing of the opening cap, the screwing can be completed before 360° revolution of the cutting portion from the start of the cutting of the closing wall by the cutting portion, and the opening cap can be screwed into the cover portion. As a result, one revolution of the cutting portion cannot be achieved after the start of the cutting by the cutting portion, and hence an uncut portion of the closing wall can remain as a part of the closing wall. In consequence, it can be avoided that the whole periphery of the closing wall is cut and the closing wall falls to disturb the pouring of the contents by the closing wall itself. Consequently, the smooth pouring of the contents can be assured.

Furthermore, the container for inspection according to the present invention may have a constitution that the closing wall has cut lines on a peripheral portion thereof.

According to such a constitution, the closing wall can gradually be cut without applying an extra force, and therefore labor for the cutting can be alleviated and an accurate cut line is formed. In consequence, the pouring passage can surely be secured.

Furthermore, the container for inspection according to the present invention may have a constitution having an area where the opening cap and the cover portion are overlapped without cutting the closing wall by the cutting portion, when the opening cap is attached to the cover portion.

According to such a constitution, there is formed the area where the opening cap and the cover portion are overlapped without cutting the closing wall by the cutting portion when the opening cap is attached to the cover portion. Thus, the container main body can be sealed by the cover portion while the opening cap is attached, and the container for inspection can integrally be stored, keeping the sealing state. In consequence, it is not necessary to handle the opening cap as another article, and its handling is easy.

Furthermore, the container for inspection according to the present invention may have a constitution that the opening cap is provided with a filter for filtrating the contents, and the filter is disposed at a position not to contact the contents, in a condition that the opening cap is attached to the cover portion and the cutting portion cuts the closing wall to enable pouring out the contents.

According to such a constitution, since the filter is attached to the opening cap, the container can be stored in a condition that the filter does not contact the contents before the opening of the closing wall, and after the opening of the closing wall, the contents can be filtrated by the filter to extract necessary substances and to remove unnecessary substances.

In addition, since the filter is disposed at the position not to contact the contents in the condition that the opening cap is attached to the cover portion and the cutting portion cuts the closing wall to enable pouring out the contents, for example, the contact of the filter with the contents can be avoided until a point of time immediately before a filtering operation, in a case where the opening cap is attached to the cover portion while the container for inspection is vertically stood.

In consequence, there can be prevented a problem such as clogging by swelling of the filter which is caused by the contact between the contents and the filter before the filtering operation, and the filtering function of the filter can be kept in a suitable state until a time point immediately before the filtering operation which is carried out while the container for inspection is inverted.

Effect of the Invention

According to the present invention described above, the sealing properties of the container containing the contents by the cover portion can be secured, and the closing wall can be cut by the opening cap attached to the cover portion without removing the cover portion, thereby making it possible to pour out the contents.

BEST MODE FOR CARRYING OUT THE INVENTION

Hereinafter, a preferable embodiment according to the present invention will be described with reference to drawings.

Figure 1:
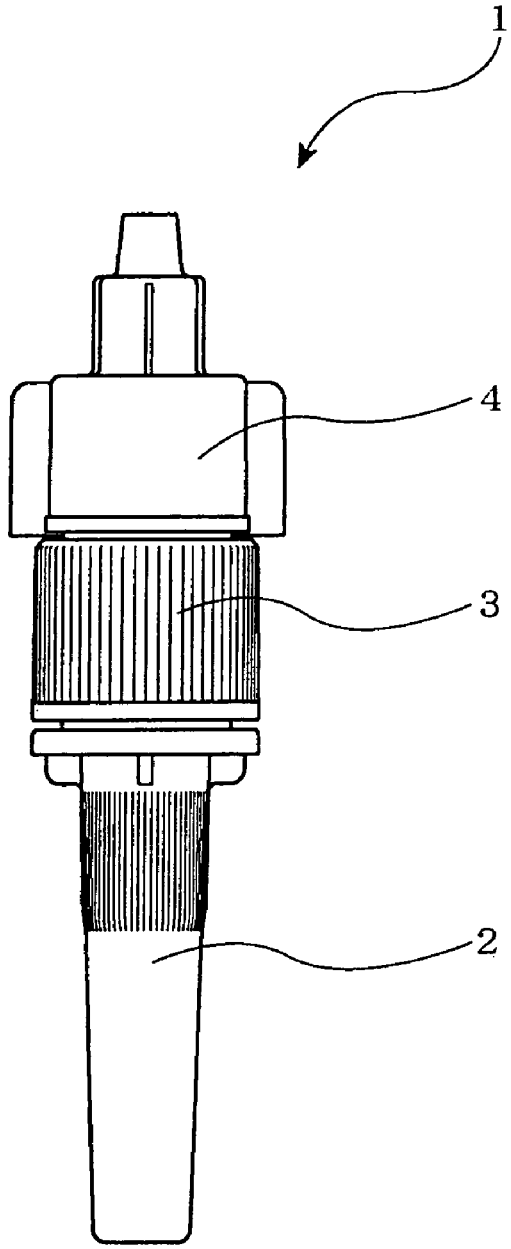
FIG. 1 is a schematic front view showing one embodiment of a container for inspection according to the present invention.

FIG. 1 is a schematic front view showing one embodiment of a container for inspection according to the present invention. A container 1 for inspection shown in FIG. 1 is constituted of three members of a container main body 2 for storing contents, a cover portion 3 which seals the container main body 2, and an opening cap 4 attached to the cover portion 3 in order from the bottom thereof in a condition that the container 1 is vertically stood.

These members can be made of, for example, thermoplastic resins, i.e., polyolefin resins such as polypropylene and polyethylene, and engineering plastics such as polyacetal and polybutylene terephthalate by use of injection molding.

It is to be noted that the respective members may be colored for the purpose of light shielding. Alternatively, they may be transparent or semitransparent so as to be visible from the outside.

Hereinafter, constitutions of the respective members will be described in detail.

Figure 2:
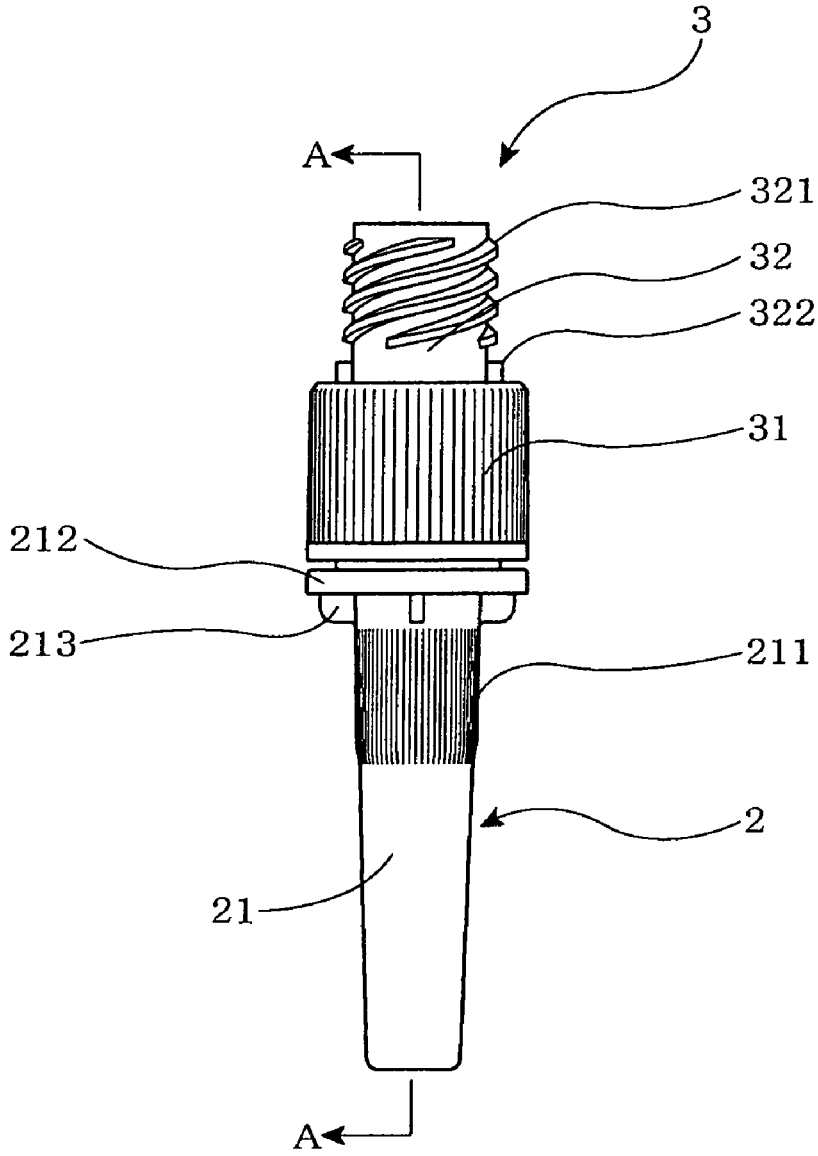
FIG. 2 is a schematic front view showing one embodiment of the container for inspection according to the present invention, and an opening cap is not attached.
Figure 3:
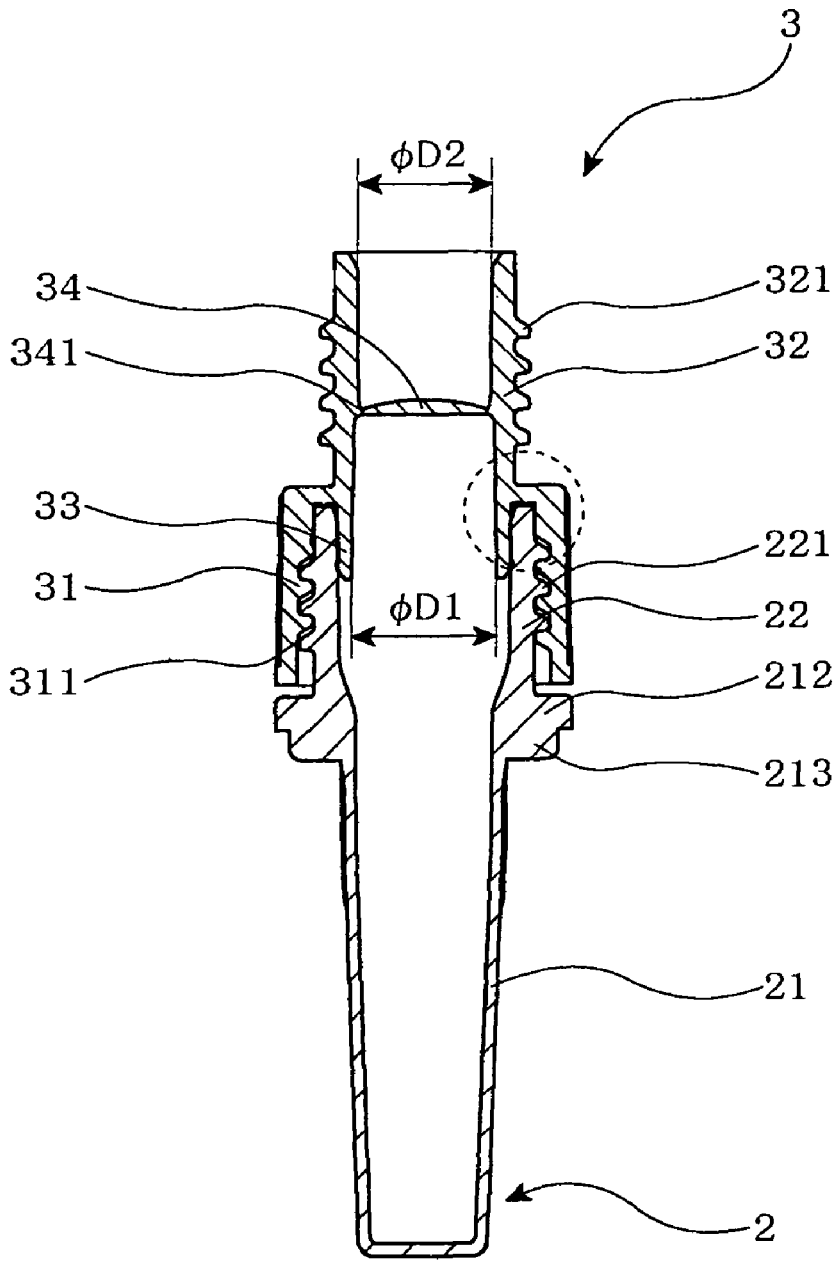
FIG. 3 is a sectional view of a container in which the opening cap is not attached and which is cut along the line A-A in FIG. 2.
Figure 4:
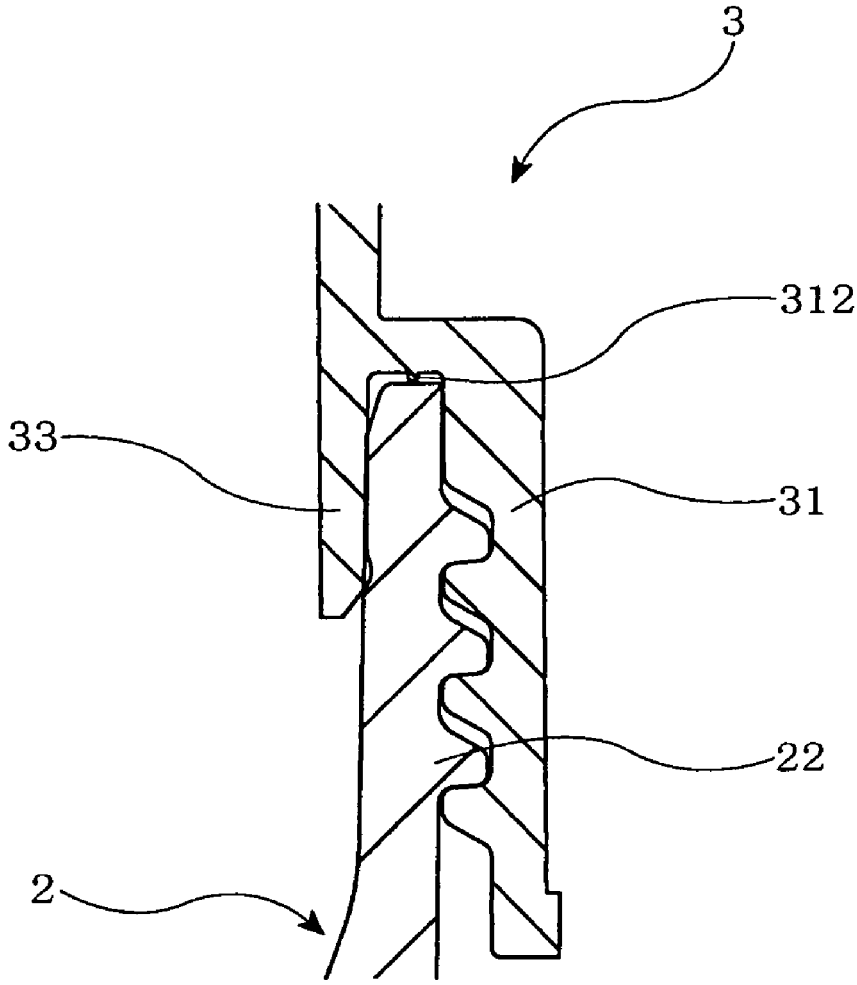
FIG. 4 is an enlarged sectional view showing a main portion surrounded by a dotted line in FIG. 3.

Here, FIG. 2 is a schematic front view showing one embodiment of the container for inspection according to the present embodiment in which the opening cap is not attached, FIG. 3 is a sectional view of the container main body cut along the line A-A in FIG. 2, and FIG. 4 is an enlarged sectional view showing a main portion surrounded by a dotted line in FIG. 3.

[Container Main Body]

As shown in the respective drawings, the container main body 2 has a cylindrical shape with a bottom, and is provided with a storing portion 21 positioned on the downside thereof for storing the contents, and a mouth portion 22 through which the contents can be poured in and out on the upside thereof.

Figure 8:
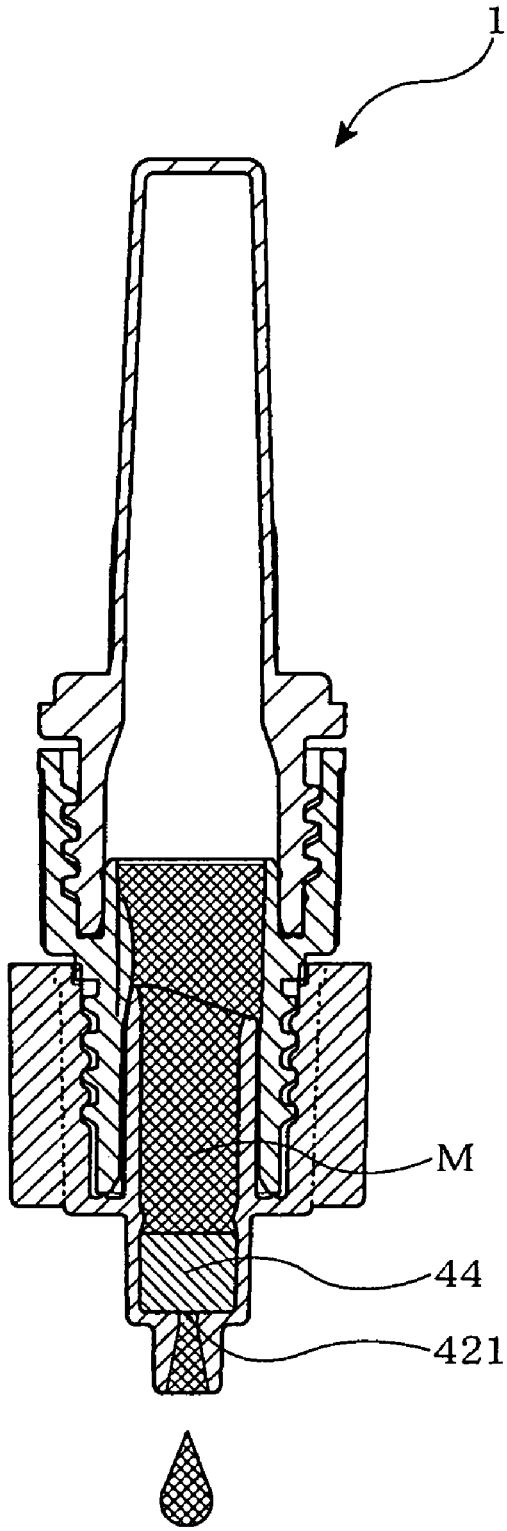
FIG. 8 is a schematic sectional view showing a pouring state of contents in one embodiment of the container for inspection according to the present invention.

The storing portion 21 is elastic, and has such a strength as to enable pouring out the contents by inverting the container 1 for inspection and then squeezing it from the outside (see FIG. 8).

On the upper side of the storing portion 21, there is provided a knurl 211 around the outside periphery of which thin vertical ribs are formed, and on the boundary between the storing portion 21 and the mouth portion 22, there are provided a flange 212 protruded in an outer peripheral direction and grip ribs 213 (the shown embodiment includes 4 grip ribs) which droop down from the flange 212 (see FIG. 2).

The knurl 211 and the grip ribs 213 function as slip stoppers when an undermentioned cover portion member 3 is fitted into opening cap 4 by screwing, whereby the sure screwing is achieved.

Next, the upper surface of the mouth portion 22 is opened, and the outer peripheral surface thereof is provided with a screw thread 221 which enables screwing into an undermentioned cover portion 3 (see FIG. 3).

Moreover, the inner peripheral surface of the upper end of the mouth portion 22 is provided with a tapered surface so that an inner peripheral cylindrical portion 33 formed in the undermentioned cover portion 3 can easily be inserted into the mouth portion 22. For a similar reason, the outer peripheral surface of the tip of the inner peripheral cylindrical portion 33 of the cover portion 3 is also provided with a tapered surface. Both of these tapered surfaces enable the smooth insertion of the cover portion 3 into the container main body 2.

Furthermore, the bottom surface of the container main body 2 is constituted of such a bottom portion that the container 1 for inspection can stand by itself while the container is vertically stood. Moreover, the inside of the container main body 2 is formed into a shape of a cylinder with a bottom, and the inner diameter of the container main body 2 is gradually increased from the bottom surface of the container main body 2 toward the mouth portion 22.

[Cover Portion]

Next, the cover portion 3 will be described. In examples shown in the respective drawings, the cover portion 3 is a cylindrical member which can be attached to the mouth portion 22 of the container main body 2. The lower portion of the cover portion 3 is provided with a closure portion 31, and the upper portion thereof is provided with a cylindrical portion 32.

Moreover, inside the closure portion 31, there is provided the inner peripheral cylindrical portion 33 which droops down so as to be the same plane as the inner peripheral surface of the cylindrical portion 32, and inside the cylindrical portion 32, a closing wall 34 is provided.

The closure portion 31 is screwed to the mouth portion 22 of the container main body 2 to cover the mouth portion 22 of the container main body 2. A knurl is formed on the outer peripheral surface of the closure portion 31 (see FIG. 2) to function as a slip stopper at the screwing to the container main body 2 or the opening cap 4, whereby the secure screwing is achieved.

Moreover, the inner peripheral surface of the closure portion 31 is provided with a thread groove 311 which constitutes a pair with the screw thread 221 of the mouth portion 22 of the container main body 2, whereby the container main body 2 and the cover portion 3 are screwed (see FIG. 3).

It is to be noted that in the present embodiment, the cover portion 3 is fitted into the mouth portion 22 of the container main body 2 by the screwing, which is not restrictive. For example, on the inner periphery of the cover portion 3, a protrusion may be formed, and a corresponding groove may be formed in the outer periphery of the mouth portion 22. Then, the cover portion 3 and the mouth portion 22 may be fitted into each other to achieve a knock attachment.

As shown in FIG. 3, the inner peripheral cylindrical portion 33 is a tubular rib which droops down from the back surface of the top of the closure portion 31 along the same plane as the inner peripheral surface of the cylindrical portion 32 so as to form a concentric circle with the closure portion 31. The outer peripheral surface of the tip of the inner peripheral cylindrical portion 33 is provided with the tapered surface as described above, which facilitates the insertion of the cylindrical portion into the mouth portion 22 of the container main body 2.

Moreover, the inner peripheral cylindrical portion 33 is formed so that the outer diameter of the inner peripheral cylindrical portion 33 is equal to or slightly larger than the inner diameter of the mouth portion 22 of the container main body 2. In consequence, the outer peripheral surface of the inner peripheral cylindrical portion 33 comes in close contact with the inner peripheral surface of the mouth portion 22 of the container main body 2, whereby the sealing properties of the container main body 2 are secured by the cover portion 3.

Furthermore, as shown in FIG. 4, a semicircular sealing protrusion 312 is provided over the whole periphery of the back surface of the top of the closure portion 31 between the inner peripheral cylindrical portion 33 and the closure portion 31. Thus, when the cover portion 3 and the container main body 2 are screwed, the lower end of the sealing protrusion 312 abuts on the upper end surface of the mouth portion 22 of the container main body 2.

In consequence, the sealing protrusion 312 presses the upper end surface of the mouth portion 22 of the container main body 2 owing to a fastening torque generated in a vertical direction by the screwing, with the result that the secure sealing properties of the container main body 2 by the cover portion 3 are assured.

Next, the cylindrical portion 32 is formed into a cylindrical shape so as to vertically rise from the top surface of the closure portion 31, and the outer peripheral surface of the cylindrical portion 32 is provided with a screw thread 321 so as to be screwed to the undermentioned opening cap 4.

Moreover, on the lower side of the outer peripheral surface of the cylindrical portion 32, control protrusions 322 of vertical ribs are provided as control means at two left and right positions symmetrically with respect to an axis of the cylindrical portion 32 (see FIG. 2). The control protrusions 322 function as the control means for controlling the revolution region of a cutting portion 431 formed in the undermentioned opening cap 4 to less than 360° after the cutting portion 431 has begun to cut the closing wall 34. This control means will be described later in detail.

Furthermore, as shown in FIG. 3, the inner peripheral surface of the tip of the cylindrical portion 32 is provided with a tapered surface. This facilitates the insertion of a cutting tube 43 formed in the undermentioned opening cap 4.

Next, the closing wall 34 is a wall formed in the state of a thin film approximately near the center of the inner peripheral surface of the cylindrical portion 32, as shown in the same drawing.

In consequence, the upper side of the inner peripheral surface of the cylindrical portion 32 is separated from the inner peripheral surface of the portion of the cylindrical portion 32 positioned below the closing wall 34, and when the cover portion 3 is attached, the mouth portion 22 of the container main body 2 is closed. Furthermore, a V-shaped cut line 341 is formed at the peripheral edge of the upper surface of the closing wall 34 to facilitate cutting by the cutting portion 431 formed in the undermentioned opening cap 4.

Moreover, in the example shown in FIG. 3, the cylindrical portion 32 has different inner diameters on the upper side and the lower side of the closing wall 34. Specifically, an inner diameter $\phi D1$ on the lower side of the closing wall 34 is larger than an inner diameter $\phi D2$ on the upper side thereof as much as the thickness of the closing wall 34.

A reason for this is as follows.

As described later, a part of the closing wall 34 is not cut by the cutting portion 431 of the opening cap 4, so that an uncut portion is formed, and this uncut portion becomes a hinge. Moreover, when the closing wall 34 folds around this hinge as an axis along the inner side wall of the cylindrical portion 32, the closing wall 34 can be sandwiched between the outer peripheral wall of the cutting tube 43 of the opening cap 4 and the inner side wall of the cylindrical portion 32, and a pouring passage of contents can securely be assured (see FIG. 6).

According to the above-mentioned constitution of the cover portion 3, the cover portion 3 is screwed to the mouth portion 22 of the container main body 2, whereby the container main body 2 can be sealed.

It is to be noted that when the closing wall 34 is cut by the cutting portion 431 of the opening cap 4 as described later, the inner peripheral surface on the upper side of the cylindrical portion 32 is continuously connected to the inner peripheral surface of the portion of the cylindrical portion 32 positioned below the closing wall 34, whereby the passage to pour out the contents can be formed and the contents can be guided to the opening cap 4.

[Opening Cap]

Next, the opening cap will be described with reference to FIGS. 5 to 7.

Figure 5:
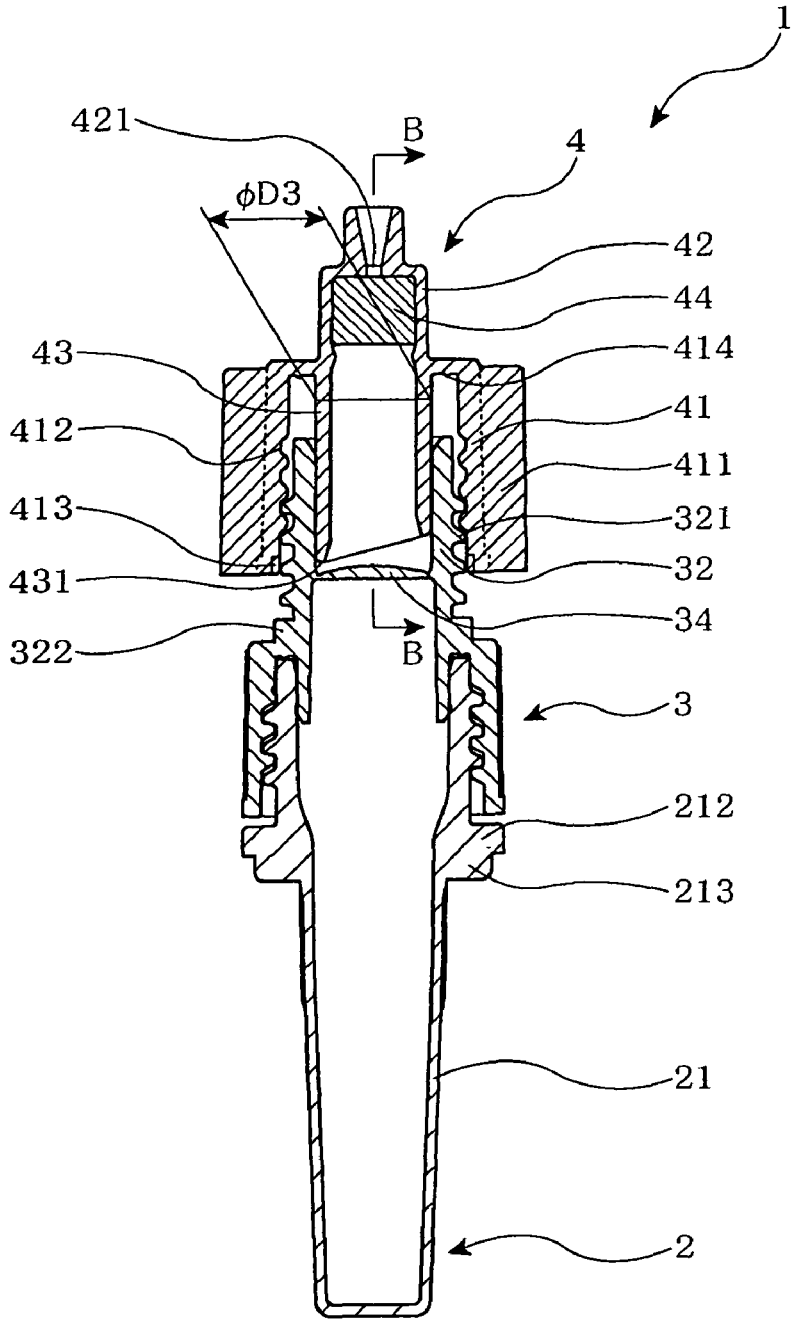
FIG. 5 is a sectional view showing one embodiment of the container for inspection according to the present invention, and the opening cap is attached in a condition that a closing wall is not cut.

FIG. 5 is a sectional view showing one embodiment of the container for inspection according to the present invention, and the opening cap is attached in a condition that the closing wall is not cut. FIG. 6 is a sectional view showing that the closing wall is cut. Moreover, FIG. 7 is a schematic sectional view of the opening cap cut along the line B-B in FIG. 5.

As shown in these drawings, the opening cap 4 includes an opening cap main body 41, a nozzle portion 42, the cutting tube 43 and a filter portion 44.

The opening cap main body 41 is a portion which is screwed to the cylindrical portion 32 of the cover portion 3 to cover the cylindrical portion 32 of the cover portion 3. On the outer peripheral surface of this opening cap main body 41, grip ribs 411 of vertical ribs are provided at two left and right positions symmetrically with respect to an axis of the opening cap main body 41, and they function as slip stoppers at the screwing to the cover portion 3, whereby the secure screwing is achieved.

Moreover, the inner peripheral surface of the opening cap main body 41 is provided with a thread groove 412 which constitutes a pair with the above-mentioned screw thread 321 of the cylindrical portion 32 of the cover portion 3, whereby the opening cap 4 and the cover portion 3 are screwed (see FIG. 5).

It is to be noted that in the present embodiment, the attachment of the opening cap 4 to the cover portion 3 is carried out by the screwing, which is not restrictive. For example, on the inner periphery of the opening cap 4, a protrusion may be formed, and a corresponding groove may be formed in the outer periphery of the cover portion 3. Then, the opening cap 4 and the cover portion 3 may be fitted into each other to achieve a knock attachment.

Here, in the example shown in FIG. 5, there is provided an area where the opening cap 4 and the cover portion 3 are overlapped without cutting the closing wall 34 of the cover portion 3 by the cutting portion 431, when the opening cap 4 is attached to the cover portion 3. Specifically, from the beginning of the screwing of the opening cap 4 and the cover portion 3, the cutting portion 431 abuts on the closing wall 34 of the cover portion 3, without cutting the closing wall 34 of the cover portion 3 by the cutting portion 431, in a condition that an effective engagement between the opening cap 4 and the cover portion 3 by the screwing is secured.

In this way, the area where the opening cap 4 and the cover portion 3 are overlapped is formed without cutting the closing wall 34 of the cover portion 3 by the cutting portion 431, immediately when the opening cap 4 is attached to the cover portion 3.

In consequence, even in the condition that the opening cap 4 is screwed, the sealing state of the container main body 2 is secured by the cover portion 3 without cutting the closing wall 34 of the cover portion 3 by the cutting portion 431, whereby the container 1 for inspection can be stored integrally with the opening cap 4. Consequently, it is not necessary to handle the opening cap 4 as another article, and its handling is easy.

Figure 7:
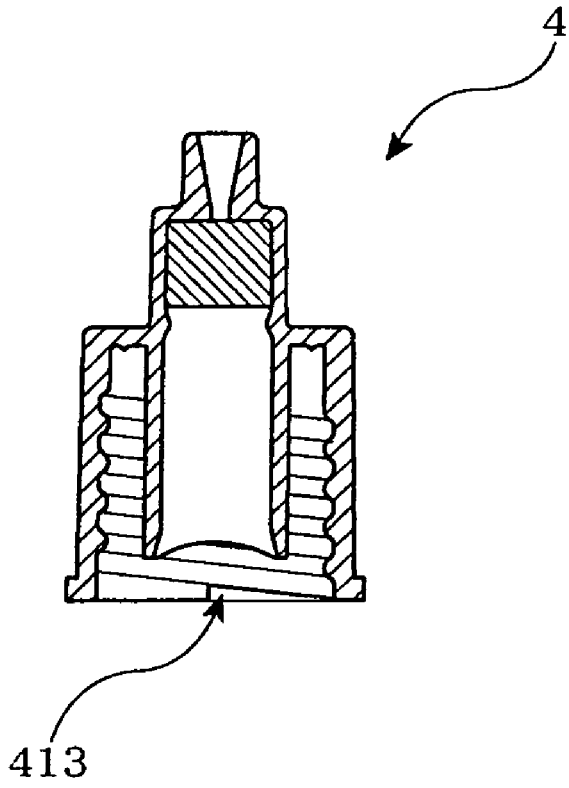
FIG. 7 is a schematic sectional view of the opening cap cut along the line B-B in FIG. 5.

Furthermore, on the inner side of the bottom surface of the opening cap main body 41, cut grooves 413 are provided as control means in two left and right positions symmetrically with respect to the axis of the opening cap main body 41 (see FIGS. 5, 7). The cut grooves 413 are provided at positions corresponding to the control protrusions 322 of the cover portion 3 mentioned above, and each cut groove 413 is a right-angle triangular concavity having a slant and an abutting surface which droops down from the slant, the slant being extended from the inner side of the bottom surface of the opening cap main body 41 along the thread groove 412 formed in the inner side surface of the opening cap main body 41.

Furthermore, the cut grooves 413 function, together with the control protrusions 322 formed in the cover portion 3 described above, as the control means for controlling the revolution region of the cutting portion 431 to less than 360° after the cutting portion 431 has begun to cut the closing wall 34 of the cover portion 3.

It is to be noted that the control means will be described later in detail.

Next, the nozzle portion 42 is formed into such a cylindrical shape as to vertically rise from the top of the opening cap main body 41, and the upper end of the nozzle portion 42 is provided with a pouring outlet 421 having a small hole through which the contents can be poured out.

When such a pouring outlet 421 is formed, an amount of the contents to be poured out can finely be regulated, and the diffusion of the contents due to the fly of the contents into the outside can be minimized, whereby the safety of an inspector is secured.

Next, the cutting tube 43 is a tubular rib which droops down from the back surface of the top of the opening cap main body 41 and which forms a concentric circle with the opening cap main body 41, and additionally, the cutting tube 43 has a bamboo spear-like shape formed by cutting a cylindrical shape obliquely upwardly from the undermost end of the rib as a base point.

Moreover, the tip of the cutting tube 43 is provided with the cutting portion 431 formed into a slant having an acute angle to cut the closing wall 34 of the cover portion 3.

It is to be noted that the cutting of the closing wall 34 of the cover portion 3 by the cutting portion 431 will be described later.

Furthermore, the cutting tube 43 is formed so that an outer diameter ϕD3 thereof is slightly larger than the inner diameter ϕD2 of the cylindrical portion 22 of the cover portion 3. In consequence, the outer peripheral surface of the cutting tube 43 comes in close contact with the inner peripheral surface of the cylindrical portion 32 of the cover portion 3 without any space therebetween, whereby the leakage of the contents is avoided and the contents can be guided to the pouring outlet 421. Furthermore, as described later, the above constitution makes it possible to produce an effect that the cutting of the closing wall 34 of the cover portion 3 by the cutting portion 431 is assisted.

Additionally, as in the case of the sealing protrusion 312 formed on the cover portion 3 shown in FIG. 4, a semicircular sealing protrusion 414 is provided over the whole periphery of the back surface of the top of the opening cap main body 41 between the cutting tube 43 and the opening cap main body 41. Owing to the thus provided sealing protrusion 414, when the opening cap 4 and the cover portion 3 are screwed, the lower end of the sealing protrusion 414 abuts on the upper end surface of the cylindrical portion 32 of the cover portion 3.

In consequence, the sealing protrusion 414 presses the upper end surface of the cylindrical portion 32 of the cover portion 3 by a fastening torque generated in a vertical direction owing to the screwing, whereby the opening cap 4 is sealed and hence the contents can securely be guided to the pouring outlet 421 without any leakage.

The filter portion 44 is a member provided so as to be surrounded by the inner peripheral surface of the nozzle portion 42 and in the vicinity of the pouring outlet 421. Moreover, the material of the filter portion 44 is not particularly limited, as long as it is inactive to a target substance to be analyzed. Specific examples of the material include porous substances such as polyurethane sponge, polypropylene, polyethylene, polyester and filter paper, and fibrous substances such as glass wool and absorbent cotton. It is more preferable to use a glass wool filter, or a membrane filter made of polypropylene, cellulose acetate, regenerated cellulose, polycarbonate or PTFE, or the like, which have a predetermined pore diameter.

Furthermore, the filter portion 44 may be made of one type of filter or may be formed by laminating two or more types of filters. It is also preferable to use an filter for sterile filtration having low adsorption properties.

When the filter portion 44 is provided, the contents can be filtrated to extract necessary substances and to remove unnecessary substances.

Moreover, since the filter portion 44 is provided in the vicinity of the pouring outlet 421 so as to be surrounded by the inner peripheral surface of the nozzle portion 42, the filter portion 44 is disposed not to contact the contents in the condition that the opening cap 4 is attached to the cover portion 3 while the container 1 for inspection is vertically stood and the cutting portion 431 cuts the closing wall 34 of the cover portion 3 to enable pouring out the contents. Consequently, the contact of the filter portion 44 with the contents is avoided until a point of time immediately before a filtering operation. In consequence, there can be prevented a problem such as clogging by swelling of the filter portion 44 which is caused by the contact between the contents and the filter portion 44 before the filtering operation, and the filtering function of the filter portion 44 can be kept in a suitable state until a time point immediately before the filtering operation which is carried out while the container 1 for inspection is inverted.

[Cutting of Closing Wall]

Next, the cutting of the closing wall 34 of the cover portion 3 by the cutting portion 431 of the opening cap 4 will be described with reference to FIGS. 5 and 6.

As shown in FIG. 5, the cutting tube 43 of the opening cap 4 is first inserted into the cylindrical portion 32 of the cover portion 3. Since the cutting tube 43 is inserted while led by the tapered surface formed on the cylindrical portion 32 of the cover portion 3 as described above, the cutting tube 43 is easily inserted.

Subsequently, the screw thread 321 of the cover portion 3 and the thread groove 412 of the opening cap 4 begin to be screwed, and the opening cap 4 relatively moves downwards while rotating (spiral movement).

Furthermore, in a condition that the downward movement of the opening cap 4 proceeds and the effective screwing of the opening cap 4 and the cover portion 3 is secured, the cutting portion 431 of the opening cap 4 abuts on the upper surface of the closing wall 34 of the cover portion 3. Specifically, the slant having an acute angle formed on the cutting portion 431 of the cap 4 abuts so as to fit into the V-shaped cut line 341 of the closing wall 34 of the cover portion 3.

Figure 6:
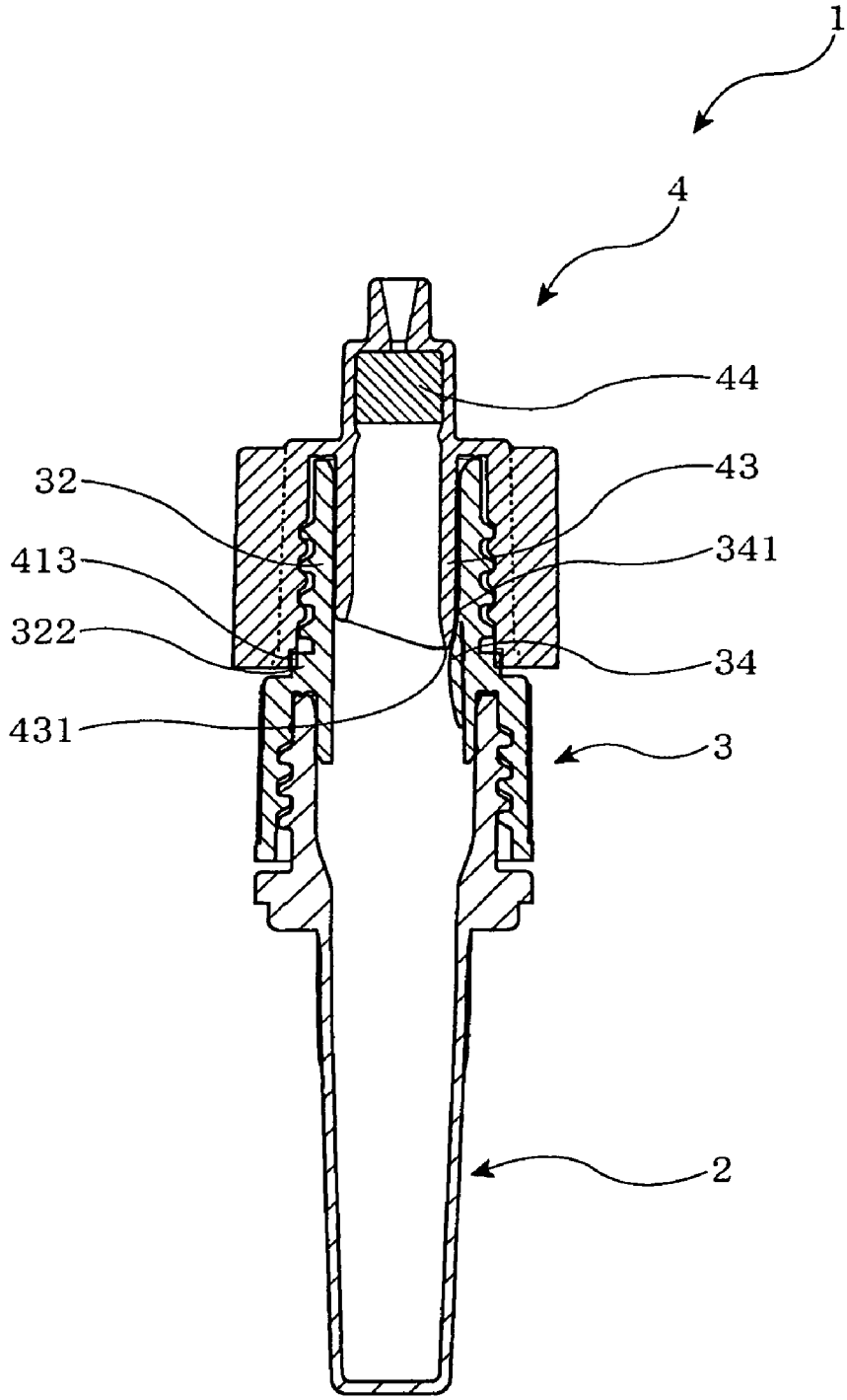
FIG. 6 is a sectional view showing one embodiment of the container for inspection according to the present invention, and the closing wall is cut.

Furthermore, as the screwing proceeds, the cutting portion 431 of the opening cap 4 is revolved while contacting the closing wall 34 of the cover portion 3 as shown in FIG. 6, whereby the closing wall 34 of the cover portion 3 is cut along the cut line 341.

Thus, a constant fastening torque which vertically acts by the screwing is transmitted to the closing wall 34 of the cover portion 3, whereby the cutting portion 431 of the cap 4 stably presses the closing wall 34 of the cover portion 3, and the closing wall 34 of the cover portion 3 is gradually cut by the revolution of the cutting portion 431 of the cap 4. Therefore, it can be avoided that the contents are abruptly splashed by a difference between pressures inside and outside the container, whereby the safety of the inspector is secured.

Moreover, the cutting portion 431 of the cap 4 is revolved to cut the closing wall 34 along the cut line 341 of the cover portion 3 without applying an extra force, and therefore labor for the cutting can be alleviated. Furthermore, an accurate circular cut line is formed, whereby a tubular pouring passage can be secured, and the contents can securely be poured out.

It is to be noted that as described above, the outer diameter ϕD3 of the cutting tube 43 of the cap 4 is slightly larger than the inner diameter ϕD2 of the cylindrical portion 32 of the cover portion 3. This can produce effects that the close contact between the outer peripheral surface of the cutting tube 43 of the cap 4 and the inner peripheral surface of the cylindrical portion 32 of the cover portion 3 is promoted and that the cutting of the closing wall 34 of the cover portion 3 by the cutting portion 431 of the cap 4 is facilitated.

Specifically, the outer diameter ϕD3 of the cutting tube 43 of the cap 4 is larger than the inner diameter ϕD2 of the cylindrical portion 32 of the cover portion 3, whereby when the cutting tube 43 of the cap 4 is inserted into the cylindrical portion 32 of the cover portion 3, the closing wall 34 of the cover portion 3 is pulled toward the inner wall surface of the cylindrical portion 32 of the cover portion 3, with the result that the cover portion 3 is deformed in a direction in which the diameter of the closing wall 34 increases.

In consequence, the wall thickness of the closing wall 34 of the cover portion 3 at the vertex of the V-shape of the cut line 341 of the cover portion 3 further decreases. Once the cutting begins, the closing wall 34 functions so as to promote the cutting, so that the cutting by the cutting portion 431 of the cap 4 is facilitated.

As described above, the closing wall 34 of the cover portion 3 is cut by the cutting portion 431 of the cap 4, whereby the upper side of the inner peripheral surface of the cylindrical portion 32 of the cover portion 3 is continuously connected to the inner peripheral surface of the portion of the cylindrical portion 32 positioned below the closing wall 34 of the cover portion 3, and the passage for pouring out the contents is formed. Simultaneously, the closing wall 34 of the cover portion 3 which closes the mouth portion 22 of the container main body 2 is opened, and the sealed state of the container main body 2 is released.

In consequence, all of the inner side wall of the container main body 2, the inner side wall of the cover portion 3 and the inner side wall of the opening cap 4 are continuously connected thereto, to secure the pouring passage of the opening cap 4 to the pouring outlet 421, whereby the contents can be poured out through the pouring outlet 421.

Moreover, as described above, the filter portion 44 of the opening cap 4 is provided in the vicinity of the pouring outlet 421 of the opening cap 4 so as to be surrounded by the inner peripheral surface of the nozzle portion 42 of the opening cap 4. In consequence, even in a condition that the sealed state of the container main body 2 is released to enable the extraction of the contents, the filter portion 44 of the opening cap 4 does not come in contact with the contents while the container 1 for inspection is vertically stood.

Consequently, it is possible to prevent a problem such as the clogging by the swelling of the filter portion 44 of the opening cap 4 which is caused by the contact between the contents and the filter portion 44 of the opening cap 4 before the filtering operation, and the filtering function of the filter portion 44 of the opening cap 4 can be kept in the suitable state until the time point immediately before the filtering operation which is carried out while the container 1 for inspection is inverted.

It is to be noted that the filtering operation using the filter portion 44 of the opening cap 4 will be described later.

[Control Means]

Next, the control means will be described with reference to FIGS. 6 and 7.

As described above, the control means is constituted of the control protrusions 322 of the cover portion 3 and the cut grooves 413 of the opening cap 4, and is configured to control the revolution region of the cutting portion 431 of the opening cap 4 to less than 360° after the cutting portion 431 of the opening cap 4 has begun to cut the closing wall 34 of the cover portion 3.

When the opening cap 4 and the cover portion 3 are screwed, this control means functions so as to control the revolution of the opening cap 4 in the final stage of the screwing.

Specifically, after the cutting portion 431 of the opening cap 4 has begun to cut the closing wall 34 of the cover portion 3, the cutting portion 431 of the opening cap 4 further revolves, so that the cutting of the closing wall 34 of the cover portion 3 proceeds. Afterward, when the cutting portion 431 of the opening cap 4 revolves to such a position that the revolution region of the cutting portion 431 of the opening cap 4 is less than 360° from the beginning of the cutting, the vertical abutting surfaces formed in the cut grooves 413 of the opening cap 4 abut on the side surfaces of the control protrusions 322 of the cover portion 3.

In consequence, since the control means limits the revolution of the cutting portion 431 of the opening cap 4, the cutting of a part of the closing wall 34 of the cover portion 3 by the cutting portion 431 of the opening cap 4 is disturbed, whereby the part of the closing wall 34 of the cover portion 3 that is not cut, i.e., the uncut portion is formed as a part of the closing wall 34 of the cover portion 3.

In consequence, the uncut portion plays a role of the hinge of the closing wall 34 of the cover portion 3, and as shown in FIG. 6, the closing wall 34 of the cover portion 3 is received and sandwiched between the outer peripheral wall of the cutting tube 43 of the opening cap 4 and the inner side wall of the cylindrical portion 32 of the cover portion 3.

The reception of the closing wall 34 of the cover portion 3 in this manner is achieved by the constitution that the closing wall 34 of the cover portion 3 is downwards pressed by the cutting portion 431 of the opening cap 4, so that the closing wall 34 falls down toward the inner side wall of the cylindrical portion 32 of the cover portion 3 around the uncut portion as the axis (the hinge), and by the constitution that the inner diameters of the cylindrical portion 32 of the cover portion 3 are different as described above, i.e., the diameter (ϕD1) of the lower side of the closing wall 34 of the cover portion 3 is different from the diameter (ϕD2) of the upper side thereof as much as the thickness of the closing wall 34 of the cover portion 3 (ϕD1>ϕD2).

In consequence, it is prevented that the closing wall 34 of the cover portion 3 drops out and the pouring of the contents is disturbed by the dropped closing wall 34 itself of the cover portion 3, whereby the smooth pouring of the contents is secured.

It is to be noted that the control means is not limited to the constitution of the control protrusions 322 of the cover portion 3 and the cut grooves 413 of the opening cap 4. For example, there can also be employed, as the control means, the contact between the sealing protrusion 414 formed on the back surface of the top of the opening cap main body 41 and the upper end surface of the cylindrical portion 32 of the cover portion 3 by the screwing of the cover portion 3 and the opening cap 4, as described above.

[Pouring of Contents]

The pouring of the contents stored in the container 1 for inspection according to the present embodiment will be described with reference to FIG. 8.

FIG. 8 is a schematic sectional view showing the pouring state of the contents in one example of the container for inspection according to the present embodiment. Contents M stored in the container main body 2 are mixed reagents including genetic DNAs of pathogenic bacteria.

First, the opening cap 4 is attached to the cover portion 3 while the container 1 for inspection is vertically stood as described above. In consequence, the closing wall 34 of the cover portion 3 is cut, whereby the pouring passage of the contents M to the pouring outlet 421 of the opening cap 4 is secured. In this state, the filter portion 44 of the opening cap 4 does not come in contact with the contents M as described above. In consequence, the filtering function of the filter portion 44 of the opening cap 4 can be kept in the suitable state until a time point immediately before the filtering operation.

Then, as shown in the same drawing, when the container 1 for inspection is inverted, the filter portion 44 of the opening cap 4 comes in contact with the contents M for the first time. At this time, by the filtrating function of the filter portion 44 of the opening cap 4, the unnecessary substances of the contents M are filtered out by the filter portion 44 of the opening cap 4 to extract the necessary substances only. Furthermore, when the container main body 2 is squeezed by an external force, the predetermined amount of the necessary substances of the contents M can only be dropped and poured out through the pouring outlet 421 of the opening cap 4.

Moreover, owing to the sealing properties of a connecting portions of the respective members, the necessary substances of the contents M can be guided to the pouring outlet 421 of the opening cap 4 without any leakage.

As described above, according to the container for inspection of the present embodiment, the container main body 2 containing the contents can be brought into a sealing state by the cover portion 3, the fly of the pathogenic bacteria during an inspection and the like can be avoided, and the safety of the inspector can be secured.

Moreover, when the opening cap 4 is screwed to the cover portion 3, the cutting portion 431 formed in the opening cap 4 cuts the closing wall 34 of the cover portion 3, whereby the contents stored in the container main body 2 can be poured out through the pouring outlet 421 of the opening cap 4 without removing the cover portion 3.

In consequence, it is possible to pour out the contents without removing the cover portion 3, whereby the safety of the inspector is secured and the complication of attachment and detachment of the opening cap 4 can be eliminated, which improves an inspection efficiency and makes the inspection speedy to shorten a waiting time of a patient. In addition, after the cut of the closing wall 34 of the cover portion 3, the diffusion of the contents is minimized by the opening cap 4, whereby the safety of the inspector is secured and the necessary amount of the contents can be poured out.

The preferable embodiment of the present invention has been described above, but the present invention is not limited to the above embodiment only, and needless to say, various modifications are possible in the scope of the present invention.

In above embodiment, the opening cap 4 is screwed to the cover portion 3, and by the screwing of the opening cap 4, the cutting portion 431 of the opening cap 4 cuts the closing wall 34 of the cover portion 3. However, as described above, attaching the opening cap 4 to the cover portion 3 may be achieved by knock attachment, and along with the knock attachment, the cutting portion 431 of the opening cap 4 may push and cut the closing wall 34 of the cover portion 3. In this case, the closing wall 34 can instantaneously be cut, so that the efficiency of the inspection can be improved.

Industrial Applicability

As described above, a container for inspection according to the present invention can be utilized in gene amplifying methods such as a LAMP method and a PCR method, another gene detection method, immunity measurement by an immunoassay method, microorganism inspection, and the like. Additionally, the above container can broadly be utilized as a container which enables the speedy inspection while securing the safety of an inspector in not only the field of medical treatment or medical drug but also the field of chemistry and the like.

The invention claimed is:

1. A container for inspection for storing and poring out contents, comprising:

a container main body having a mouth portion formed thereon, a cover portion attached to the mouth portion to seal the container main body, and an opening cap attached to the cover portion, wherein the cover portion has a closure portion screwing and covering the mouth portion, a cylindrical portion formed in a cylindrical shape so as to vertically rise from a top surface of the closure portion, an inner peripheral cylindrical portion drooping down from inside of the top surface of the closure portion so as to have a same plane as an inner surface of the cylindrical portion, and a closing wall disposed in the cylindrical portion and closing the mouth portion, an inner diameter on an upper part of the cylindrical portion is different from an inner diameter on a lower part of the cylindrical portion and the inner diameter on the lower part of the cylindrical portion is larger than the inner diameter on the upper part of the cylindrical portion as much as a thickness of the closing wall, the opening cap is provided with a pouring outlet and a cutting portion for cutting the closing wall, and when the opening cap is attached to the cover portion, the cutting portion cuts the closing wall to enable pouring out the contents.

2. The container for inspection according to claim 1, wherein the cutting portion pushes and cuts the closing wall, whereby the cutting of the closing wall is achieved.

3. The container for inspection according to claim 1, wherein the cutting portion is rotated while contacting the closing wall, whereby the closing wall is cut.

4. The container for inspection according to claim 3, wherein the opening cap is attached to the cover portion by screwing, and when the opening cap is screwed, the cutting portion cuts the closing wall.

5. The container for inspection according to claim 3, wherein the cutting portion has control means for controlling a rotation range of the cutting portion to less than 360° after the cutting portion has begun to cut the closing wall, and the control means prevents a part of the closing wall to be cut, whereby a fall of the closing wall is avoided.

6. The container for inspection according to claim 1, wherein the closing wall has cut lines on a peripheral portion thereof.

7. The container for inspection according to claim 1, wherein an area where the opening cap and the cover portion are overlapped without cutting the closing wall by the cutting portion is present in the container, when the opening cap is attached to the cover portion.

8. The container for inspection according to claim 1, wherein the opening cap is provided with a filter for filtrating the contents, and the filter is disposed at a position not to contact the contents, in a condition that the opening cap is attached to the cover portion and the cutting portion cuts the closing wall to enable pouring out the contents.

9. The container for inspection according to claim 1, wherein the closure portion has a first sealing protrusion over an entire periphery of a back surface of a top of the closure portion.

10. The container for inspection according to claim 1, wherein the opening cap further includes a cutting tube, the cutting portion is present at an end of the cutting tube, and an outer diameter of the cutting tube is larger than the inner diameter on the upper part of the cylindrical portion.

11. The container for inspection according to claim 10, wherein the cutting tube has a bamboo spear shape at an end thereof.

12. The container for inspection according to claim 10, wherein the opening cap further includes an opening cap main body, and the opening cap has a second sealing protrusion over an entire periphery of a back surface of a top of the opening cap main body formed between the cutting tube and the opening cap main body.

* * * * *